US011173414B2

(12) United States Patent
Martis et al.

(10) Patent No.: US 11,173,414 B2
(45) Date of Patent: Nov. 16, 2021

(54) DEVICE FOR DISPENSING AND LAYING DOWN A TOY PLAY SURFACE

(71) Applicant: InRoad Toys, LLC, Crofton, MD (US)

(72) Inventors: David V. Martis, Odenville, AL (US); Andrew J. Musliner, Crofton, MD (US)

(73) Assignee: INROAD TOYS, LLC, Crofton, MD (US)

( * ) Notice: Subject to any disclaimer, the term of this patent is extended or adjusted under 35 U.S.C. 154(b) by 0 days.

(21) Appl. No.: 16/791,246

(22) Filed: Feb. 14, 2020

(65) Prior Publication Data

US 2020/0261820 A1 Aug. 20, 2020

Related U.S. Application Data

(60) Provisional application No. 62/805,490, filed on Feb. 14, 2019.

(51) Int. Cl.

| | |
|---|---|
| ***A63H 33/30*** | (2006.01) |
| ***A63H 33/00*** | (2006.01) |
| ***A63H 17/00*** | (2006.01) |
| *A63H 29/22* | (2006.01) |

(52) U.S. Cl.

CPC ..... *A63H 33/3072* (2013.01); *A63H 17/00* (2013.01); *A63H 33/005* (2013.01); *A63H 29/22* (2013.01)

(58) Field of Classification Search

CPC .. A63H 33/005; A63H 33/3072; A63H 33/14; A63H 33/00; A63H 17/00; A63H 17/05; A63H 18/00; B65H 35/0026; B65H 35/0033; B65H 35/004

See application file for complete search history.

(56) References Cited

U.S. PATENT DOCUMENTS

| | | | | | |
|---|---|---|---|---|---|
| 2,487,061 | A * | 11/1949 | Kelman | B65H 37/04 | 156/541 |
| 3,658,628 | A * | 4/1972 | Zenter | B65H 35/0033 | 156/527 |
| 3,871,940 | A * | 3/1975 | Antonioni | B05C 9/10 | 156/353 |
| 3,900,362 | A * | 8/1975 | Schaffer | B65H 35/004 | 156/577 |
| 4,588,469 | A * | 5/1986 | Hunter | B65H 35/004 | 156/527 |
| 5,000,715 | A * | 3/1991 | Johnson | A63H 17/05 | 238/10 B |
| 5,445,703 | A * | 8/1995 | Steeves | B65H 35/004 | 156/527 |
| 6,302,177 | B1 * | 10/2001 | Gruber | B65H 35/0033 | 156/527 |

(Continued)

*Primary Examiner* — Eugene L Kim
*Assistant Examiner* — Alyssa M Hylinski
(74) *Attorney, Agent, or Firm* — Leason Ellis LLP

(57) ABSTRACT

A toy road paving device (toy dispenser) is provided that simulates a real-world road paving machine by dispensing, laying down, cutting, and smoothing either one or multiple strips of spooled tape material upon a hard, flat surface such as a table or floor. The device "paves" the tape road easily, smoothly, evenly, and without the risk of tearing the tape material from excess stress. More generally, the device can lay out any toy play surface printed on tape, a strip of paper, or other material. The device can be operated manually or mechanically powered.

25 Claims, 16 Drawing Sheets

(56) References Cited

U.S. PATENT DOCUMENTS

Figure 1:
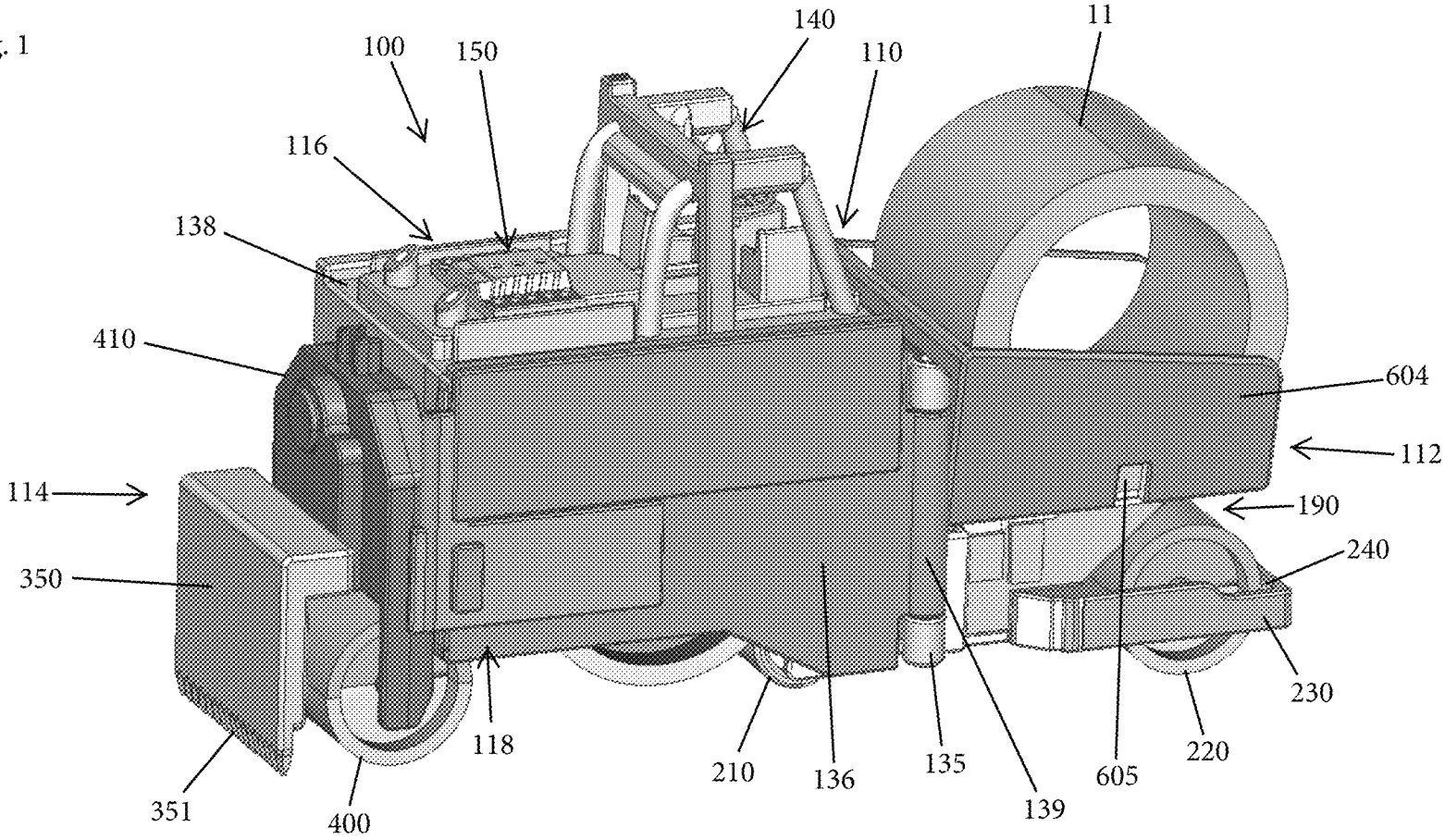
Figure 2:
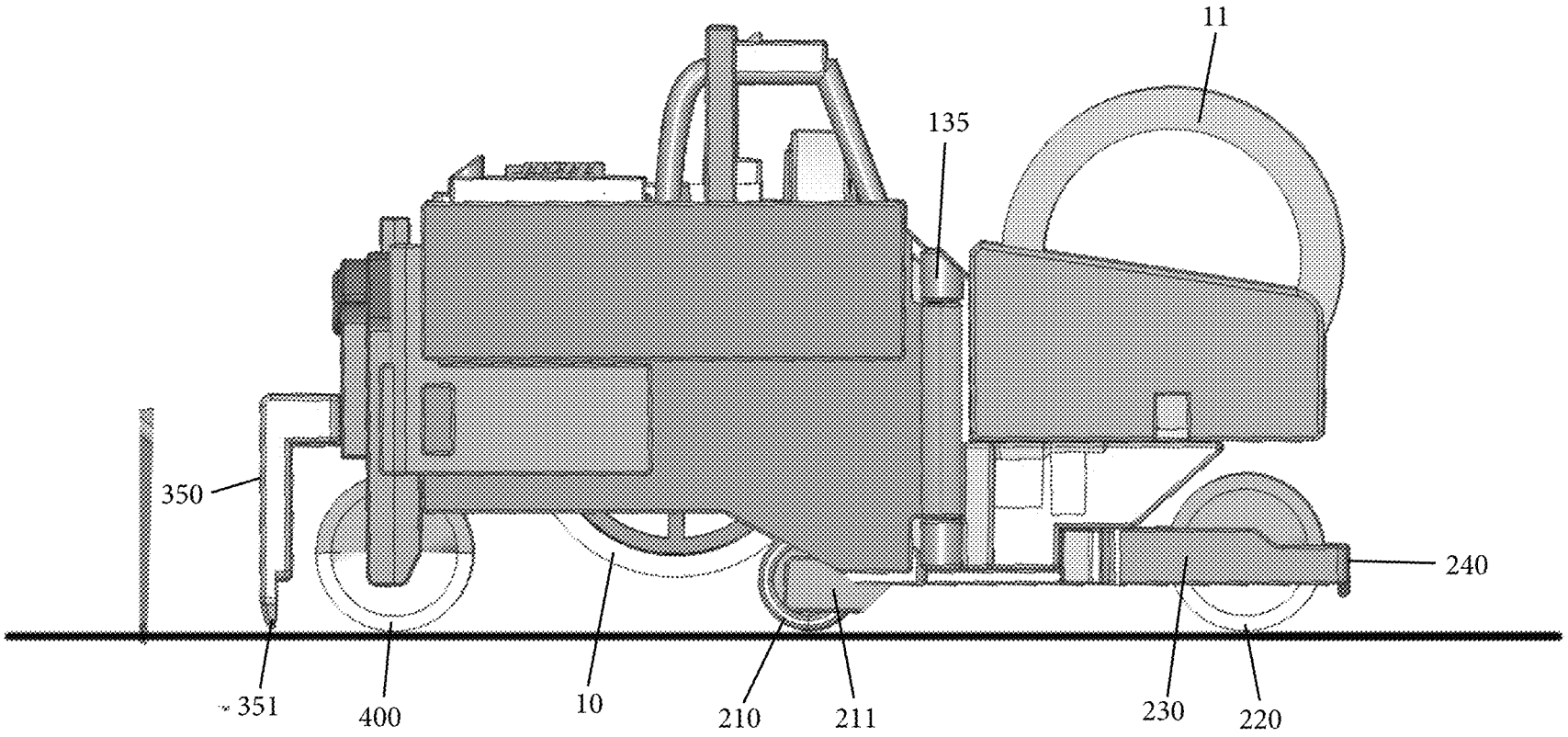
Figure 3:
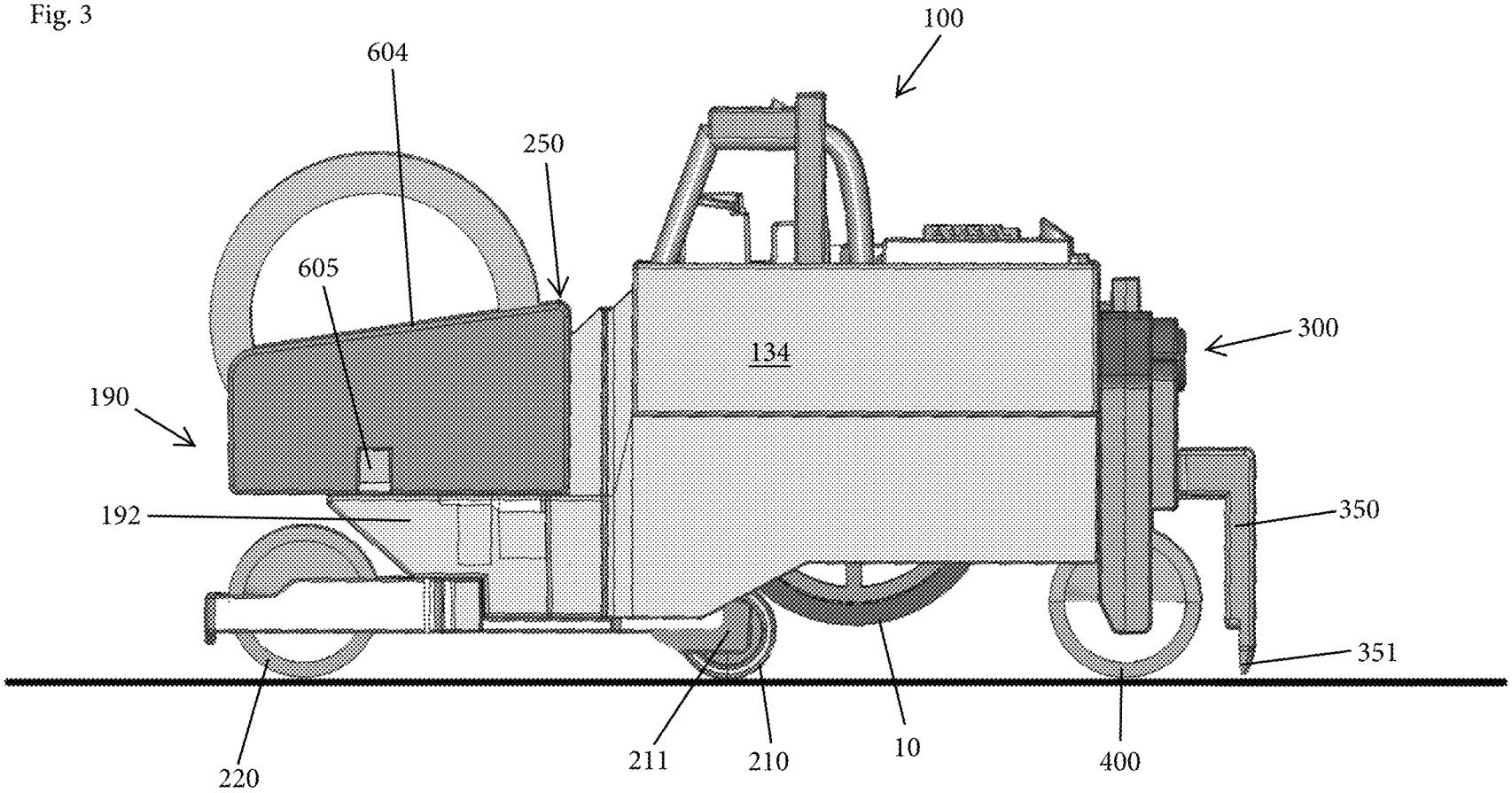
Figure 4:
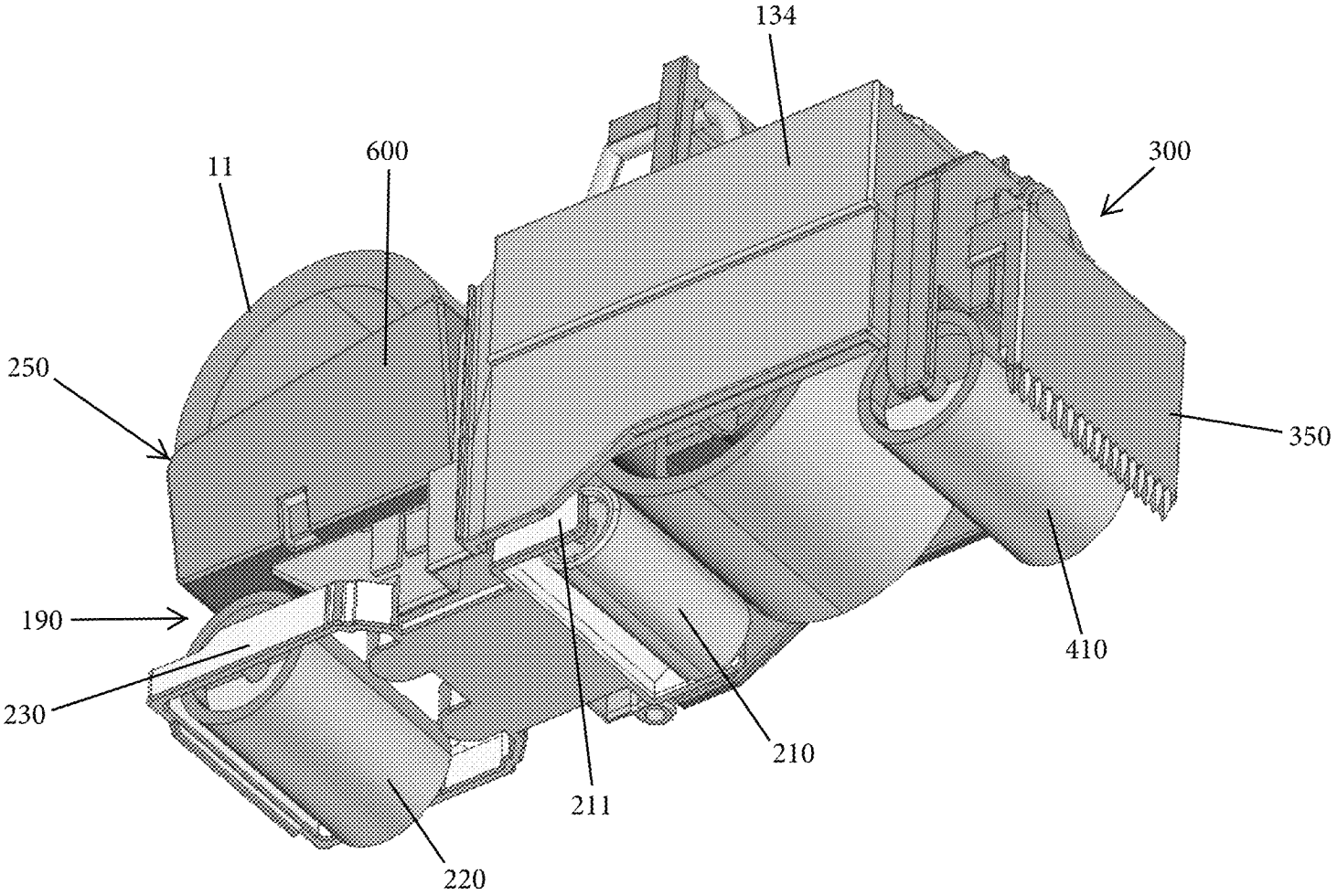
Figure 5:
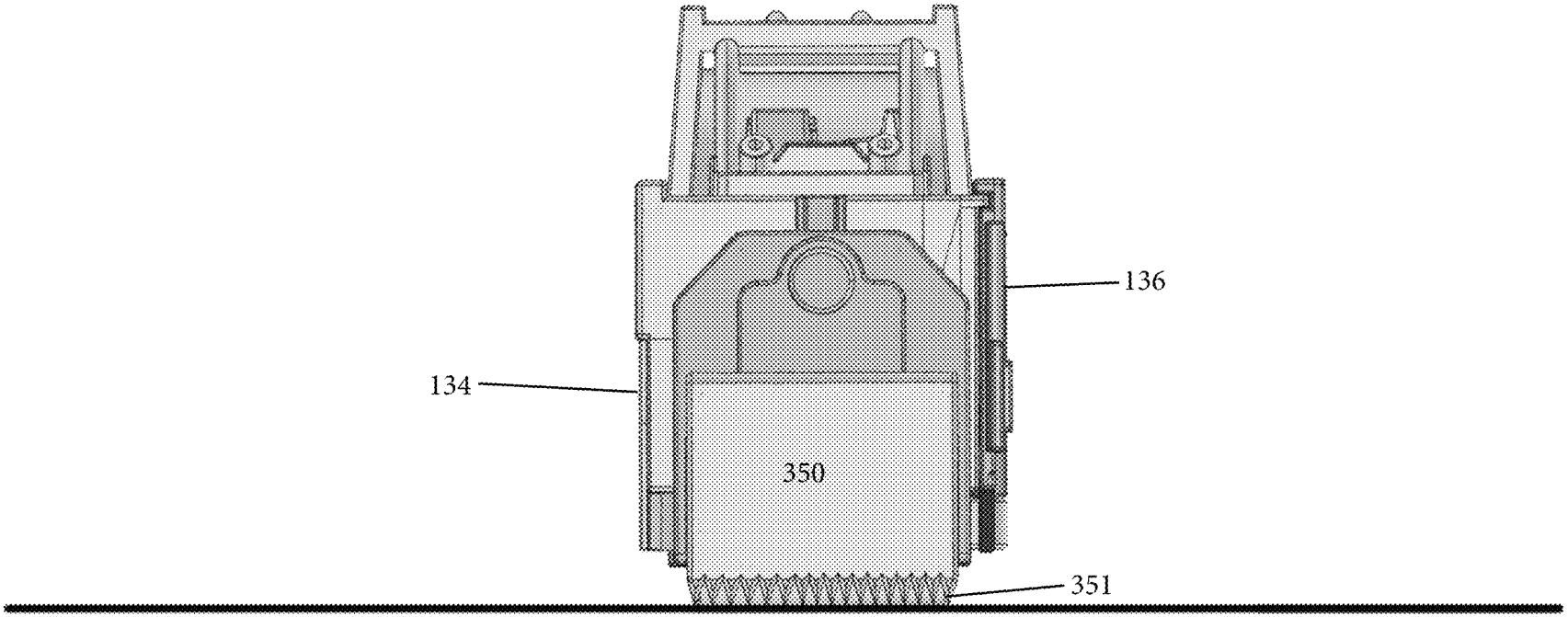
Figure 6:
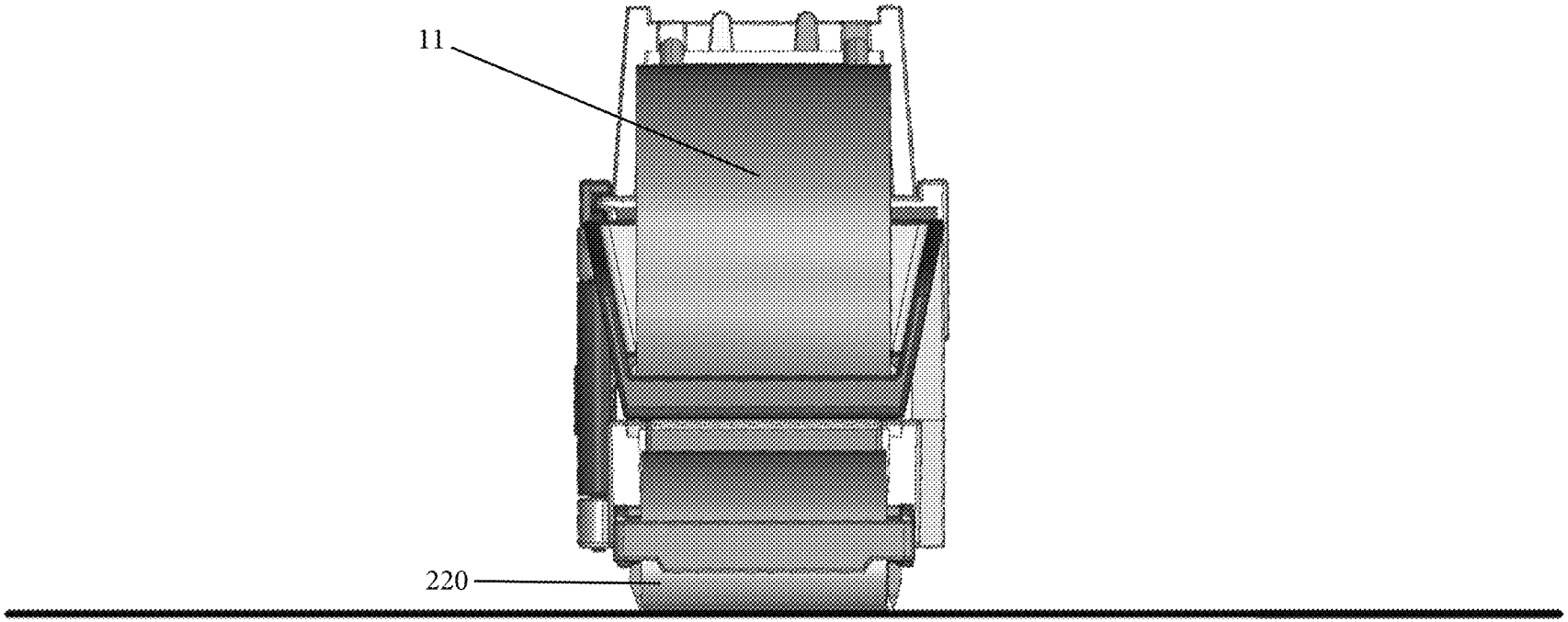

| | | | | |
|---|---|---|---|---|
| 7,028,941 | B2 * | 4/2006 | Ibrahim | E04D 15/06 156/577 |
| 7,676,948 | B2 * | 3/2010 | Miles | B65H 35/0086 33/758 |
| 2013/0273804 | A1 * | 10/2013 | Rossi | A63F 9/0096 446/310 |
| 2014/0090785 | A1 * | 4/2014 | Nguyen | B65H 35/004 156/516 |
| 2018/0105385 | A1 * | 4/2018 | Chuah | B65H 35/0026 |

* cited by examiner

DEVICE FOR DISPENSING AND LAYING DOWN A TOY PLAY SURFACE

CROSS-REFERENCE TO RELATED PATENT APPLICATIONS

This application is based on and claims priority to U.S. Provisional Patent Application 62/805,490, filed Feb. 14, 2019, the entire contents of which is incorporated by reference herein as if expressly set forth in its respective entirety herein.

TECHNICAL FIELD

The present invention is generally directed to a toy and more particularly, is directed to a toy that emulates a paver and is configured to dispense and lay down a toy play surface, such as spooled tape material, that can have an adhesive bottom layer for detachably adhering the tape material to an applied surface, such as the floor or table top surface.

BACKGROUND

Many instances of child play involve emulating real-world activity. Playing with a dollhouse with miniature furniture or playing with a child-sized kitchen that has plastic food are common examples of pretend play emulating the real world. Similarly, a child desires to operate a toy automobile upon a simulated road or highway, or play with a toy airplane on a simulated runway or taxiway. Inventions exist that enable a child to use a printed adhesive tape to make a toy road or runway, such as the one that is disclosed in U.S. Pat. No. 9,320,978 which is hereby incorporated by reference in its entirety. Such adhesive tape is wound on a roll and has printed indicia on one side that looks like a road, with adhesive on the other side. To use the tape, the child manually unwinds the roll and sticks it onto a play surface, such as a floor or table. This approach only goes so far in emulating the real-world process of road paving. In the real world, there exist large road paving machines (pavers) that dispense asphalt to create a road. Unfortunately, there is no product that provides an easy mechanism for the child to dispense the toy road adhesive tape onto a surface.

Prior inventions that attempted to provide a mechanism for dispensing toy road (e.g., U.S. Pat. No. 5,000,715 which is hereby incorporated by reference in its entirety) failed to address key requirements for ease-of-use and were impractical and suffered from critical design flaws and omissions. They did not provide a straightforward means to load the machine with tape road and secure the tape roll in place. They did not provide a means to easily dispense the road, requiring excessive force that a child is not likely to be able to exert or control and that tended to cause the tape road to tear. They also did not provide a mechanism to cut the tape to a desired length, a key requirement for any dispenser.

SUMMARY

According to at least one embodiment, a toy (toy play surface dispenser) is provided for laying down a toy play surface on a target surface, such as the floor or a table surface. The toy includes a vehicle body with rotatable wheels. The vehicle body has an interior compartment that contains a first rotatable spindle on which a first tape roll can be mounted. The first tape roll defines the toy place surface and can include an adhesive on a bottom surface thereof.

The toy also includes a first drive roller that comprises one of the vehicle wheels that is in contact with the target surface and is positioned forward of the first rotatable spindle. The first drive roller is further configured to be in contact with the first tape roll on the first spindle such that rotation of the first drive roller causes unwinding of the first tape roll. The first tape roll is routed to a rear roller that comprises another of the vehicle wheels and the first tape roll in fed underneath the rear roller which serves to apply a force to the first tape roll for laying the first tape along the target surface.

As described in detail herein, the toy can include other features, such as a tape cutter, a bin for holding a second roll of tape, a second rotatable spindle for holding a second roll of tape that can be laid down on the target surface in front of the first tape such that the first tape comprises an overlay layer that is disposed over and secured to the second tape. In addition, it will be readily understood that the toy can include other electronics that are configured to emit light and/or sound. For example, one or more actuators (e.g., a switch, button, etc.) can be provided for causing the toy to illuminate lights, such as driving lights, and/or produce sounds, such as an engine, through a small speaker. A small power source, such as a cell battery, can be provided for powering such lights and sounds.

BRIEF DESCRIPTION OF THE DRAWING FIGURES

FIGS. 1-16 illustrate exemplary toys in accordance with the present invention and in particular to toy dispensing devices that simulate road pavers and are configured for laying down a toy play surface (e.g., a tape that emulates a road surface) on a target surface, such as a floor or table top.

DETAILED DESCRIPTION OF CERTAIN EMBODIMENTS

Now referring to FIGS. 1-15, the present invention, according to at least one embodiment, is directed to a toy tape dispensing device (dispenser device or tape dispenser) 100 and more particularly, to a toy road paving device 100 (also referred to herein as being a machine or paver) comprised of a system and physical mechanism to easily dispense, lay down, cut, and smooth a single or multi-layered tape road 10 or other graphic pathway to a hard, flat surface such as a table or floor (the "applied surface"). For ease of discussion, the device 100 will be referred to as a tape dispenser 100 and preferably takes the form of a toy.

The tape dispenser 100 is thus preferably designed and constructed so that it has a form that is similar to and emulates a real-life paver and more particularly, the tape dispenser 100 has a main vehicle body 110 having a front end 112 and an opposing rear end 114 along with a first side 116 and an opposing second side 118. As described herein, the tape dispenser 100 is configured to ride across the applied surface much like how a paver drives along the ground.

Figure 7:
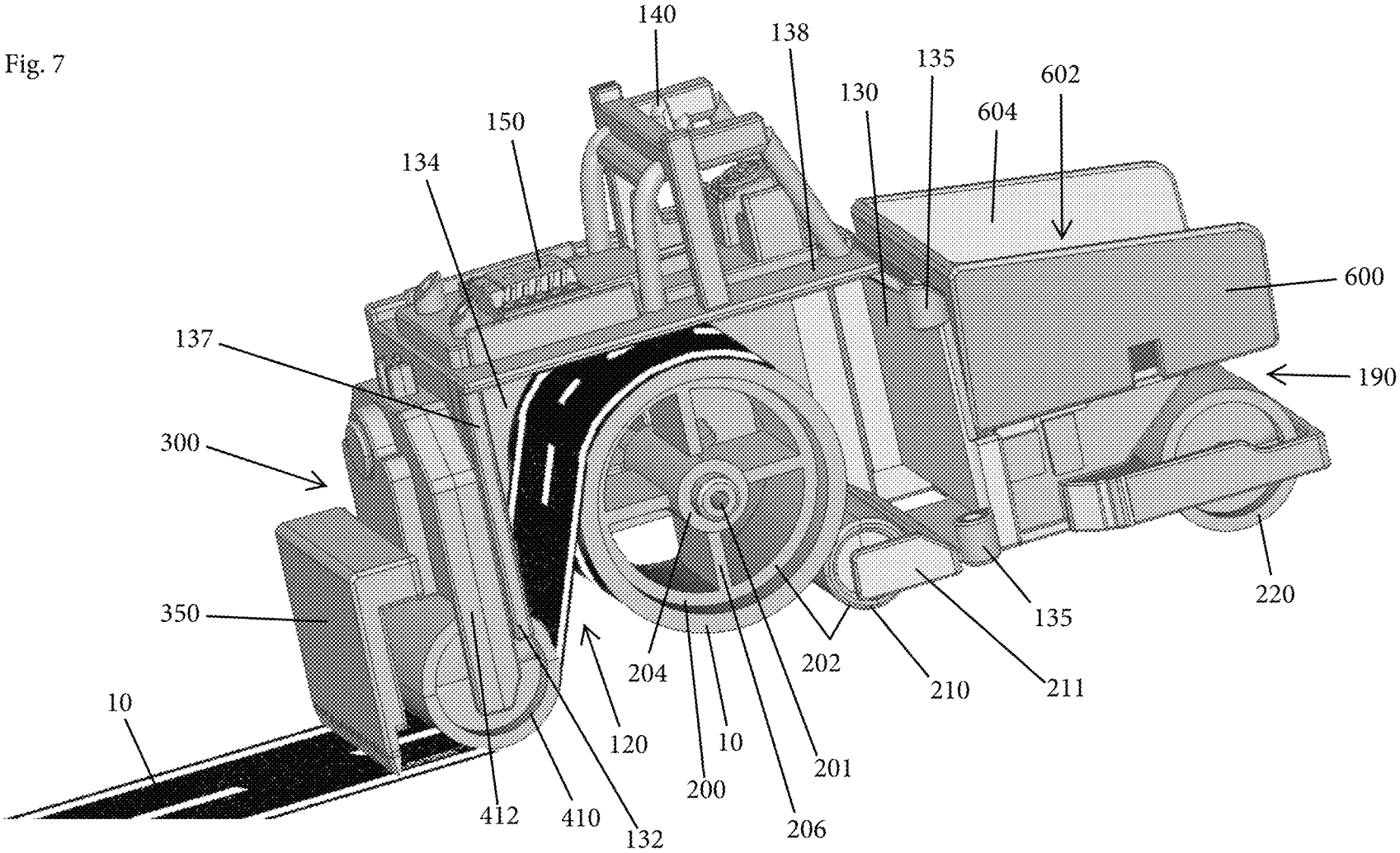
Figure 8:
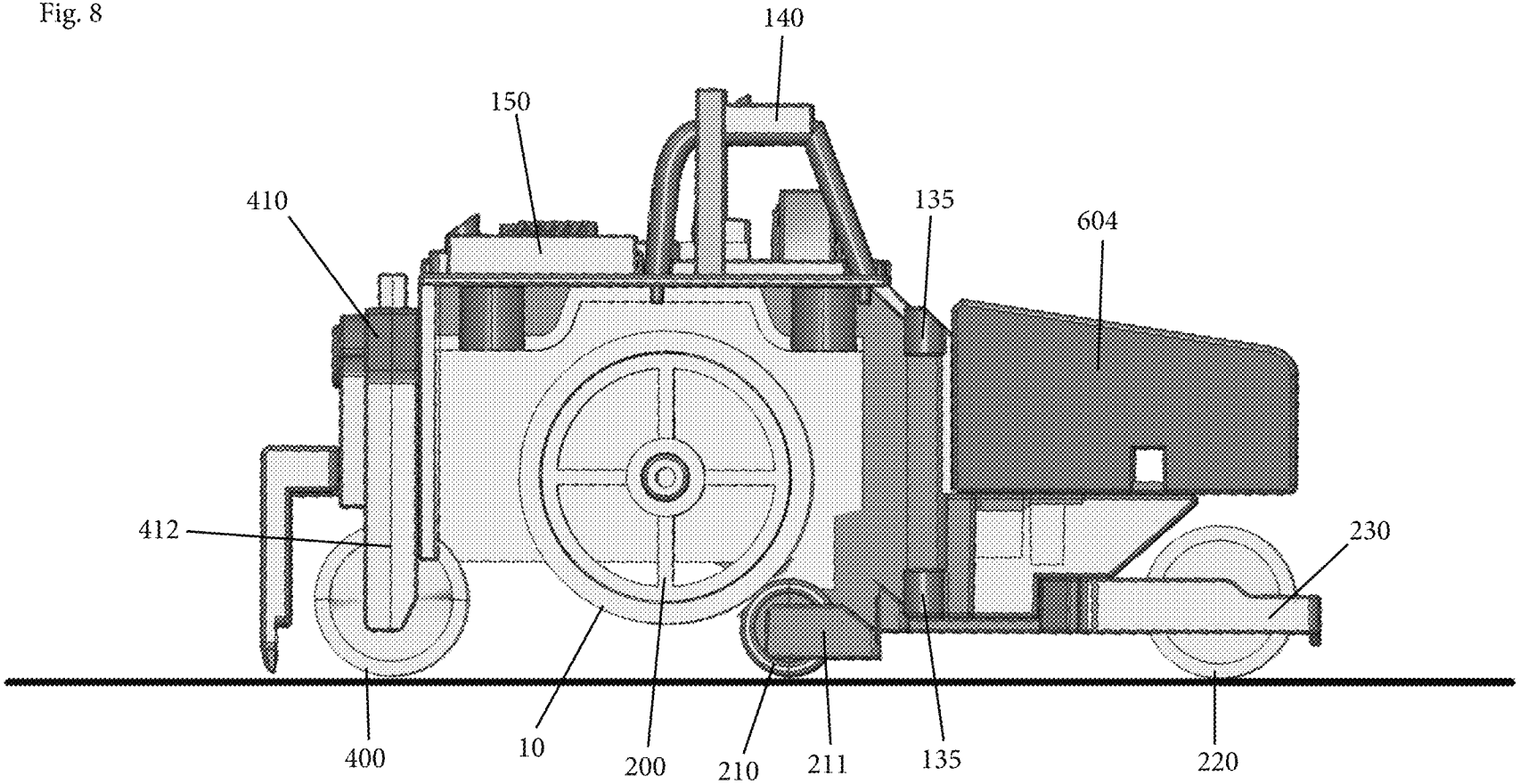
Figure 9:
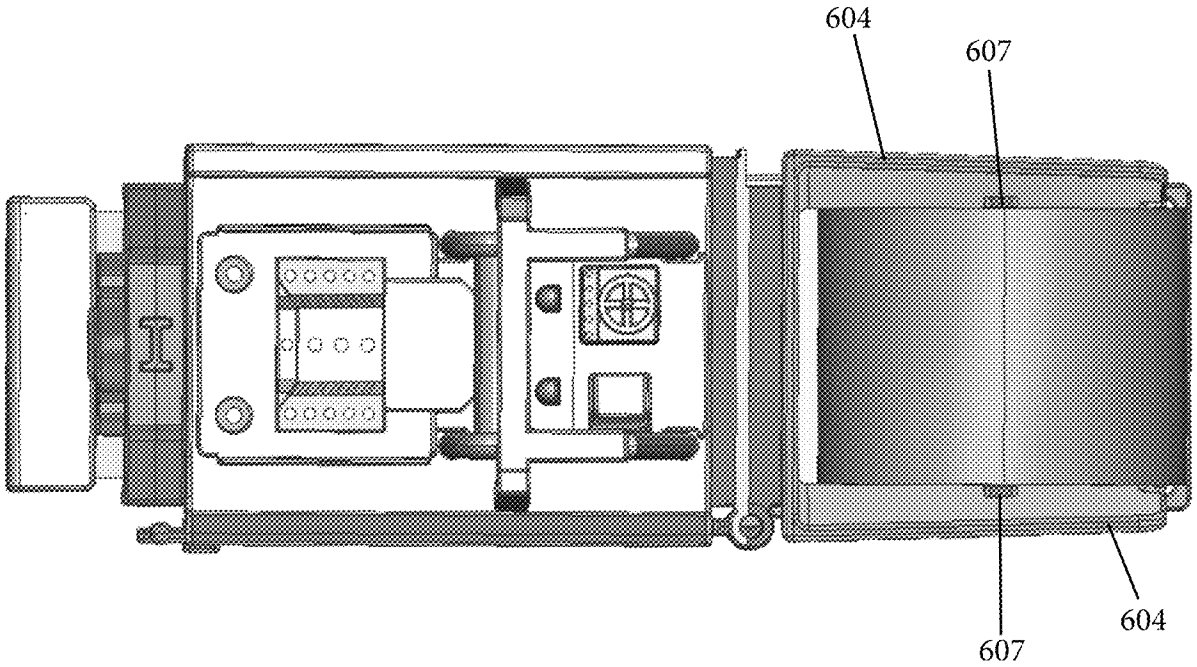
Figure 10:
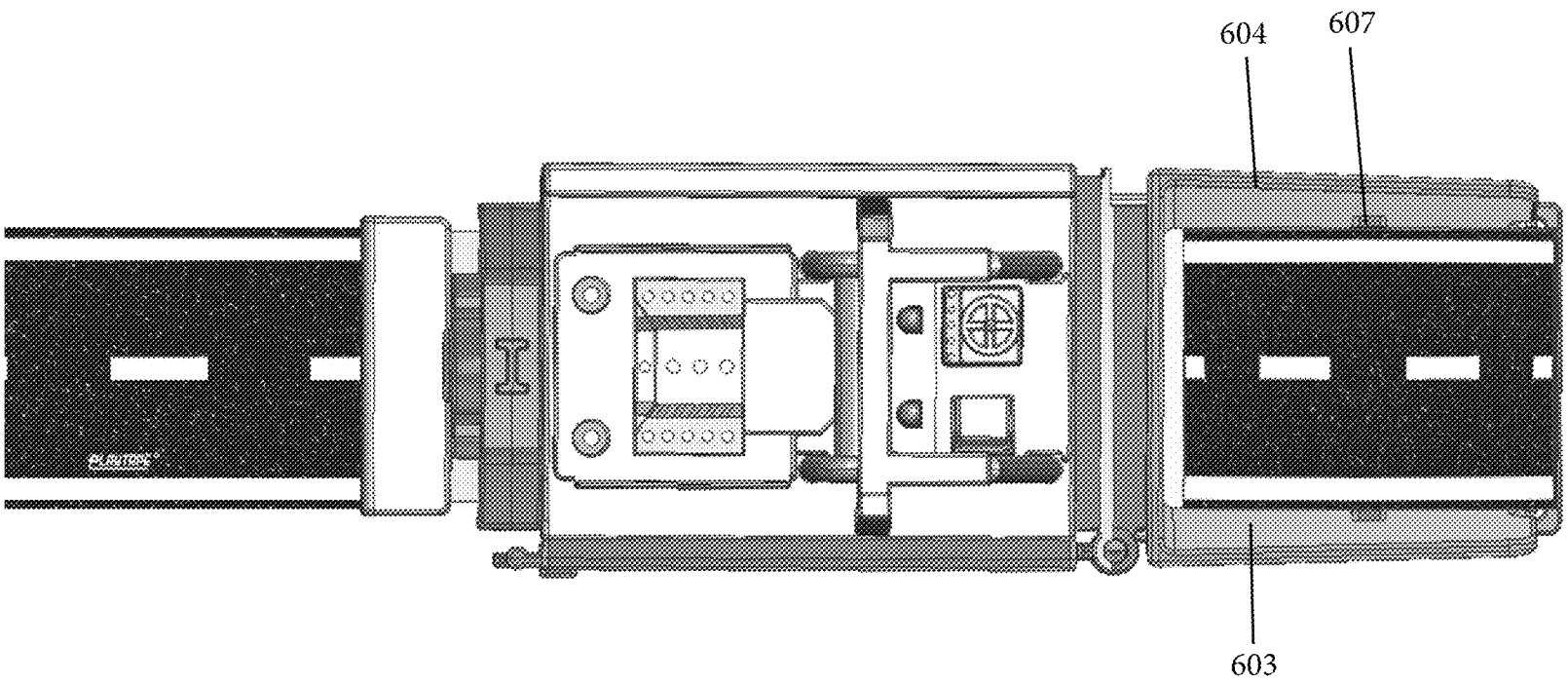
Figure 11:
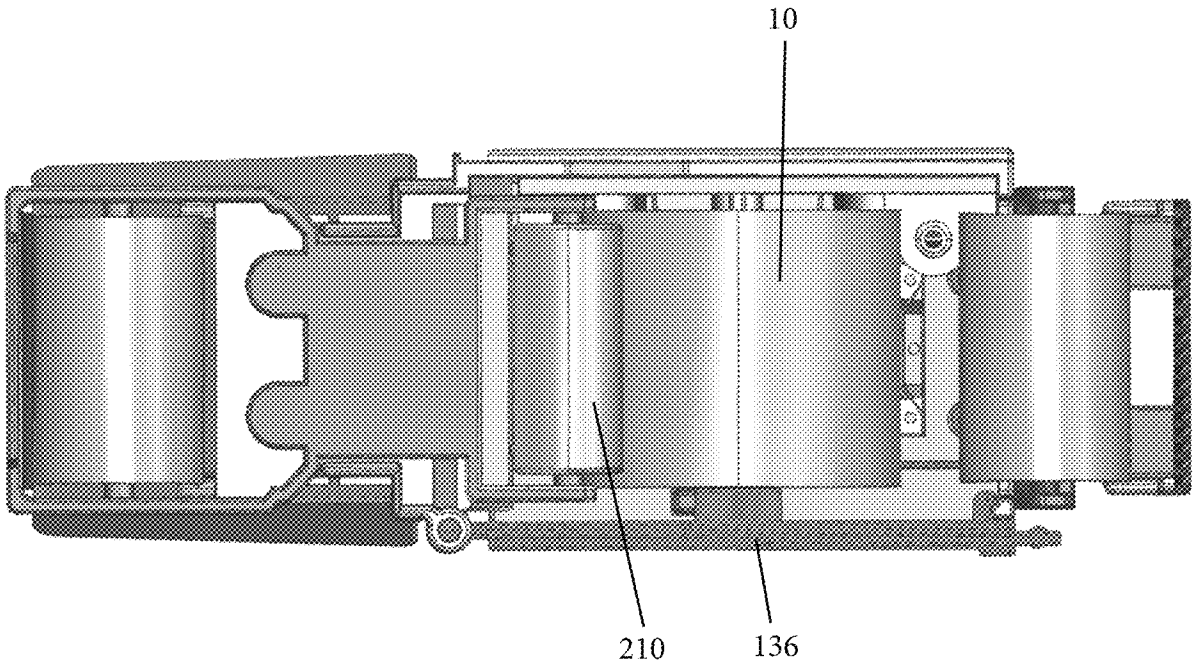

The main vehicle body 110 has a main hollow portion or main compartment (hollow tape compartment) 120 (FIG. 7). The main vehicle body 110 and the tape compartment 120 is defined by a front wall 130, an opposing rear wall 132, a first side wall 134, and an opposing second wall 136. The four walls are joined and/or abut one another to define the hollow interior space within the tape compartment 120. In the illustrated embodiment, these four walls define a rectangle. A top wall (ceiling) 138 is provided and at least partially closes off the tape compartment 120 and also, as described herein, provides a substrate for a vehicle cabin 140 and engine compartment 150. As illustrated, the vehicle cabin 140 comprises an upstanding structure defined by a cage and can include one or more seats. The engine compartment 150 also provides a realistic appearance in that it can include an engine cover and smoke stacks (exhaust). The vehicle cabin 140 is only one exemplary embodiment and other designs are possible or the vehicle cabin 140 can be completely eliminated.

The tape compartment 120 is thus the internal hollow space into which a first roll of tape (a "primary tape roll" in at least one embodiment) 10 is inserted. Both the tape roll 10 and a tape dispensing path along which the tape 10 travels to a dispensing location are exposed on a single side of the tape dispensing device 10, accessible on a single plane. This allows the user easy access for threading the tape 10 in the tape dispenser 100. Prior tape dispensers had no easy access to load the tape roll or thread the tape along the dispensing path, making it difficult or impossible to load the tape dispensing device.

Figure 12:
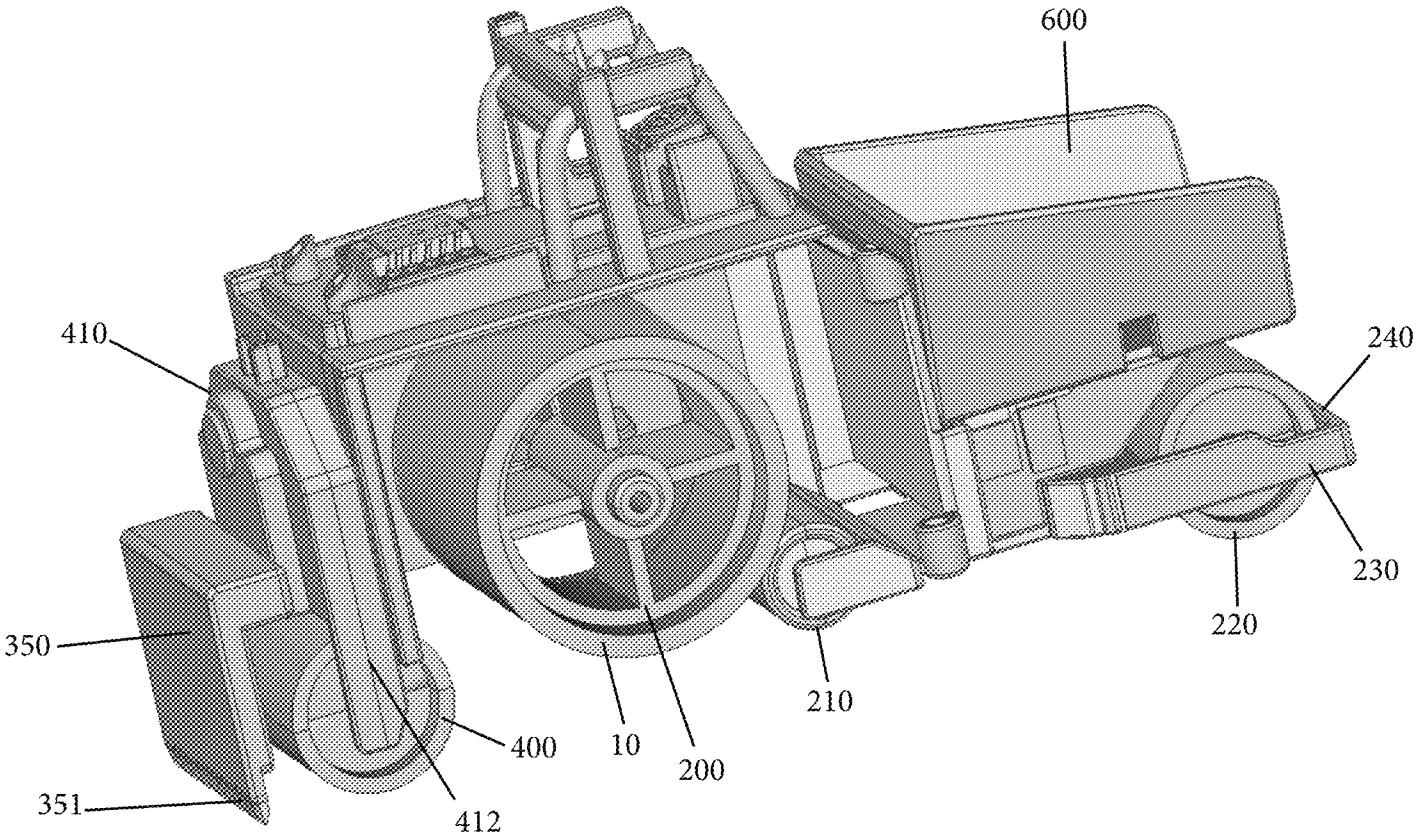

It will be understood, based on the present specification, that the first tape roll 10 can be considered to be a primary tape roll in the embodiment shown in FIGS. 1 and 12 in which only a single tape roll is dispensed at one time. Conversely, as described herein, when multiple tape rolls are dispensed, the first tape roll 10 can be considered to be an overlay tape and not a primary tape that represents the tape that is applied first and directly to the applied surface.

The first wall 130 represents a forward wall that is closest to and faces the front end 112, while the rear wall 132 represents a rear wall that is closest to and faces the rear end 114. The first side wall 134 represents a left wall, while the second side wall 136 represents a right wall. The hollow interior space within the tape compartment 120 is accessible and in the illustrated embodiment, the second side wall 136 comprises a door that is openable relative to the other three walls to allow access to the hollow interior space. For example, the second side wall 136 can be hingedly coupled to one of the front wall 130, the rear wall 132 or the first side wall 134.

In the illustrated embodiment, the second side wall 136 is hingedly attached to the front wall 130 and more particularly, the front wall 130 acts as a leaf and includes a pair of first knuckles 135 that are in the form of two cylindrical structures formed along the outer edge of the front wall 130. The two first knuckles 135 are axially aligned and can be formed at a top and bottom of the outer edge of the front wall 130. The second side wall 136 represents the other leaf and has a second knuckle 139 that is formed at one end of the second side wall 136. As with a traditional door hinge, the second side wall 136 is positioned within the second knuckle 139 being disposed between the pair of first knuckles 135 with all three being axially aligned and a pin or the like passes through the center holes of the three aligned knuckles, 135, 139, thereby hingedly coupling the second side wall 136 to the front wall 130. In this way, the second side wall 136 acts as a door that freely opens outward.

Any number of different techniques can be used to close and retain the second side wall 136 in a closed position. For example, a friction fit can be used to detachably couple the other end of the second side wall 136. More particularly, a catch can be incorporated into the rear wall 132 and can be in the form of a recessed track (groove) 137 that is formed along the outer side edge of the rear wall 132 at a location that faces the second side wall 136. One end of the second side wall 136 can include a complementary coupling feature that can be in the form of a clasp or the like or can be in the form of a protrusion that frictionally seats within the track 137. As shown in the FIG. 16, in another embodiment, the coupling mechanism is in the form of a catch 160 that is formed along an inner surface of the second side wall 136 and is designed to engage a lip formed along the outer edge of the rear wall 132. When the door (second side wall 136) is closed, the lip (outer edge) of the rear wall 132 engages the catch 160 to form a friction fit between these two parts. One of skill in the art will appreciate that other types of coupling mechanisms can be used so as to secure the door (second side wall 136) and more particularly, male/female coupling features can be used, with one associated with the rear wall 132, the other with the second side wall 136.

Within the hollow interior space of the tape compartment 120 is: (1) a first spindle 200 or the like that is configured to hold a roll of tape 10 and rotate to dispense the roll; and (2) a drive roller 210.

The first spindle 200 includes an annular shaped outer wall 202 and a center hub 204 with a plurality of strengthening spokes (ribs) 206 extending, in a radial direction, between the center hub 204 and the outer wall 202. In the illustrated embodiment, there are four spokes 206 that are oriented 90 degrees apart. The first spindle 200 is coupled to and rotates about a first spindle axle 201 that can be coupled to the first side wall 134. The first spindle axle 201 thus protrudes outwardly from the first side wall 134 into the hollow interior of the tape compartment 120. The free end of the first spindle axle 201 can include a cap or the like to ensure that the first spindle 200 remains coupled to the first spindle axle 201. Alternatively, the first spindle 200 and the first spindle axle 201 can be fixedly attached to one another and rotate in unison and it is the first spindle axle 201 that is rotatably coupled to the first side wall 134 as by a bearing connector or the like.

The tape dispenser 100 dispenses tape 10 of a kind described in U.S. Pat. No. 9,320,978, which is hereby incorporated by reference in its entirety, or any other type of self-adhesive tape with a single adhesive side where the roll core diameter and tape length are sized appropriately to fit within the dispensing device's tape compartment. The tape 10 can have a top side printed with indicia consistent with the design of a road surface, and a bottom side that has adhesive on it so that when the tape is laid down, it sticks securely to the applied surface.

The roll of tape 10 typically has a core (e.g., cardboard or plastic core) with tape material wound about the core. When the roll of tape 10 is inserted on the first spindle 200, the inner surface of the core surrounds the outer surface of the outer wall 202 of the first spindle 200 and preferably, the core contacts and intimately seats against the outer wall 202.

When the flip door (the second side wall 136) is closed, the tape compartment 120 keeps the tape roll 10 securely inside the tape dispenser 100, while also keeping it and the tape dispensing path clear from dirt and debris while the tape dispenser 100 is in use. The previously mentioned toy dispensers in the prior art had no such securing door.

Prior inventions of the type described herein use tension as a means to dispense the tape off the roll. This approach requires the user to physically pull the tape off the roll. The force required to do this is challenging for the intended user—a small child—and gets proportionally more difficult the wider the tape being dispensed. This approach also has a tendency to tear the tape due to the tension. By contrast, the present invention has a mechanism that makes dispensing easy, smooth, and consistent. More particularly, the drive roller 210 serves several purposes and acts as a main roller that allows the tape dispenser 100 to smoothly move along the applied surface and also acts as a roller that contacts and rotates the tape 10 in a direction that causes the unwinding of the tape 10. As a result, the drive roller 210 can also be considered to be a surface-to-tape roller since during use, the drive roller 210 remains in contact with both the applied surface (ground surface) and the tape 10.

The drive roller 210 is positioned within the tape compartment 120 so that the tape dispenser 100 rests on the drive roller 210 during normal use. As the tape dispenser 100 is driven forward or rearward, the drive roller 210 rotates. As mentioned above, the driver roller 210 is positioned proximate to the first spindle 200 such that the tape 10 can be inserted onto the first spindle 200 and thus be located between the first spindle 200 and the drive roller 210. By being in contact with the applied surface and also in contact with the tape 10 that is inserted onto the first spindle 200, the linear movement of the tape dispenser 100 along the applied surface is translated into rotation and unwinding of the tape 10.

The drive roller 210 is considered to be a surface-to-tape roller since during use, the drive roller 210 remains in contact with both the applied surface (ground surface) and the tape 10. As such, the drive roller 210 is to remain in contact with the tape 10 during both storage and use such that when the device 100 is in use, the drive roller 210 maintains constant contact with both the applied surface and the primary tape roll. As the tape dispenser 100 is pushed forward, the drive roller (surface-to-tape roller) 210 causes the tape 10 to unwind off the roll in a smooth, even manner. The drive roller 210 serves a number of purposes and has key benefits over prior inventions of this type with the following being exemplary characteristics of the drive roller 210:

1. It unwinds the primary tape roll evenly and smoothly, preventing stretching or tearing of the tape material.
2. Rolling the machine forward dispenses tape at exactly the same rate as the machine rolls forward, preventing bunching or snagging.
3. Rolling the machine forward has the effect of unrolling the tape automatically, making it extremely easy to dispense the tape, without requiring excessive manual force.
4. The roller itself is coated or molded with a rubbery material (e.g., rubber or silicone) which helps the machine stay in constant and consistent contact with both the applied surface and the primary tape roll.
5. The ease of dispensing makes it possible to automate dispensing of the tape road so the machine can dispense tape roads without a user's manual intervention, as further contemplated as part of this invention, as described below.

In order for the drive roller 210 to always remain in contact with the tape 10 as the tape 10 unwinds and thus has a decreasing diameter, the drive roller 210 is biased or otherwise directed or urged into contact with the tape roll 10 that rests on the first spindle 200. In one embodiment, as illustrated, the drive roller 210 is rotatably held between a pair of opposing arms 211 that are spaced apart with the drive roller 210 disposed therebetween and being rotatably coupled to the arms 211 as by an axle or the like. A biasing element, such as a spring, can be included to apply a biasing force to the drive roller 210 in the direction of the tape 10 (first spindle 200) so as to cause the drive roller 210 to be urged into contact with the outer surface of the tape 10. As the tape dispenser 100 is driven forward, the drive roller 210 rotates clockwise to cause a counter-clockwise movement of the tape 10 and first spindle 200 which results in unwinding of the tape 10. The applied biasing force can be easily overcome by applying a force to the drive roller 210 in a direction away from the tape 10 (i.e., in a forward direction of the device 100) as by using one or more fingers to urge the drive roller 210 in this direction.

Alternatively, a tension bar can be attached to the tape dispenser 100 and on one end holds the surface-to-tape roller (drive roller) 210 in place against the tape roll 10. The tension bar ensures that the roller remains in contact with the primary tape roll as well as the applied surface even as tape is being used and the overall roll decreases in diameter. As the tape roll gets smaller in diameter as tape is dispensed, tension is still applied by the tension bar because of the springiness of the bar. The tension bar may be made out of a flexible plastic to create that springiness, or it may be mechanically spring loaded to create the necessary springiness.

It will also be understood that other mechanisms can be used to constantly apply an urging force to the drive roller 210 to ensure that the drive roller 210 remains in contact with the tape 10 during the unwinding of the entire tape roll 10.

The main vehicle body 110 also includes a forward portion 190 that is provided forward of the front wall 130 and a rear portion 300 that is provided rearward of the rear wall 132. The rear portion 300 includes a rear roller 400 that is a ground contacting roller and therefore, when the device 100 moves forward and rearward on the applied surface, the rear roller 400 rotates. The rear roller 400 is also the roller that serves to apply a force to the tape 10 during a dispensing action. The first spindle 200 and the rear roller 400 in combination define a first tape path in which the tape 10 is unwound and delivered and applied directly to the applied surface in at least one embodiment. In particular, the first tape 10 is unrolled with its top surface facing upward and is delivered to the rear roll 400 and passes below the rear roller 400 onto the applied surface with the bottom adhesive surface of tape 10 facing the applied surface. As the tape dispenser 100 moves in the forward direction, the rear roller 400 rotates clockwise, like the drive roller 210, and this causes the tape 10 to be urged against and bonded to the applied surface. The rear roller 400 in effect drives over and smooths out the tape 10.

The rear roller 400 can be coupled to a rear roller frame 410 that is coupled to the rear wall 132 and includes a pair of spaced apart arms 412 between which the rear roller 400 is rotatably mounted. The ends of the rear roller 400 can thus be rotatably coupled to the arms 412. The rear wall 132 and rear roller frame 410 can be formed in parallel planes that are perpendicular to a longitudinal axis of the tape dispenser 100 and intersect the rear roller 400.

The rear portion 300 also preferably includes a cutter 350 that can be attached to the rear roller frame 410 or other section of the rear portion 300. More particularly, the cutter 350 can be a child-safe, vertical plastic cutter at the rear of the dispenser device 100 that is used to cut the dispensed tape 10 at the desired length once the tape 10 has been dispensed and laid upon the applied surface. The plastic cutter 350 uses a row of plastic teeth 351 that span the width of the tape 10 to serve as a cutting instrument. The blade teeth are vertical at 90 degrees to the tape surface. To cut the tape 10, the user pushes the vertical plastic cutter 350 down and then slightly pulls the dispenser device 100 forward and up at angle to contact the tape 10 much like a cutting action in a traditional packing tape dispenser. The teeth 351 press against the dispensed tape 10 adhered to the applied surface. The pulling motion causes the tape 10 to tear away at the point where the teeth 351 create a point of pressure. The teeth 351 cut the tape 10 fully across the width of the tape 10, perpendicular to the direction of the dispensing path (i.e., the tape 10 under the rear roller onto the applied surface). The cutting edge of the cutter can be a straight edge as opposed to having the teeth 351.

The exemplary vertical cutter 350 offers the following advantageous benefits:

1. It cuts the tape road without having to employ scissors or a knife. Because this invention is a toy, child safety is a key concern and any toy must pass rigorous third party safety tests which would preclude the use of knifes or sharp scissors.
2. The tape is cut perfectly perpendicular to the dispensing path and perpendicular to the length of the tape. This enables easy and accurate construction of intersecting roads, and abutting curves, as contemplated in U.S. Pat. No. 9,320,978.
3. The tape can be easily cut to a specific length and at a specific point along the design.

As discussed below, in the case where multiple layers of tape are dispensed simultaneously and layered on top of each other, the cutter 350 cuts through both tape layers at the same time.

The cutter 350 thus represents a rearmost structure of the device body (chassis) and can at least partially shield the rear roller 400.

In the illustrated embodiment, the cutter 350 can be an L-shaped structure that has a short leg that attaches to the rear roller frame 410 and a longer leg that extends downward from the first leg (perpendicular to the short leg) and terminates in teeth 351.

In another embodiment, it is contemplated that the cutter can be a movable device in that the blade portion with the teeth can move along a track between a retracted position and an extended position. For example, the cutter can be spring biased to the retracted position and then a user applies a force to the cutter to cause it to move downward to the extended position which is the cutting position.

The forward portion 190 is part of a housing that extends forward of the tape compartment and is located forward of the front wall 130. The forward portion 190 can have a lower body portion 192 that carries a front roller 220 as by an axle that passes through the front roller 220 and is attached at its ends to the lower body portion 192 Like the rear roller 400, the front roller 220 is a ground-contacting roller on which the tape dispenser 100 is driven. The front and rear rollers 220 and 400 can be the same size or can be different sizes. The front roller 220 can be captured between a pair of forward arms 230 that protrude and extend forwardly to a front bar or front guard 240 that extends between the two arms 230 and partially shields the front roller 220. Like a bumper, the front guard 240 protects the front roller 220 from making contact with any undesired object that is in front of the tape dispenser 100 as it is driven.

Figure 13:
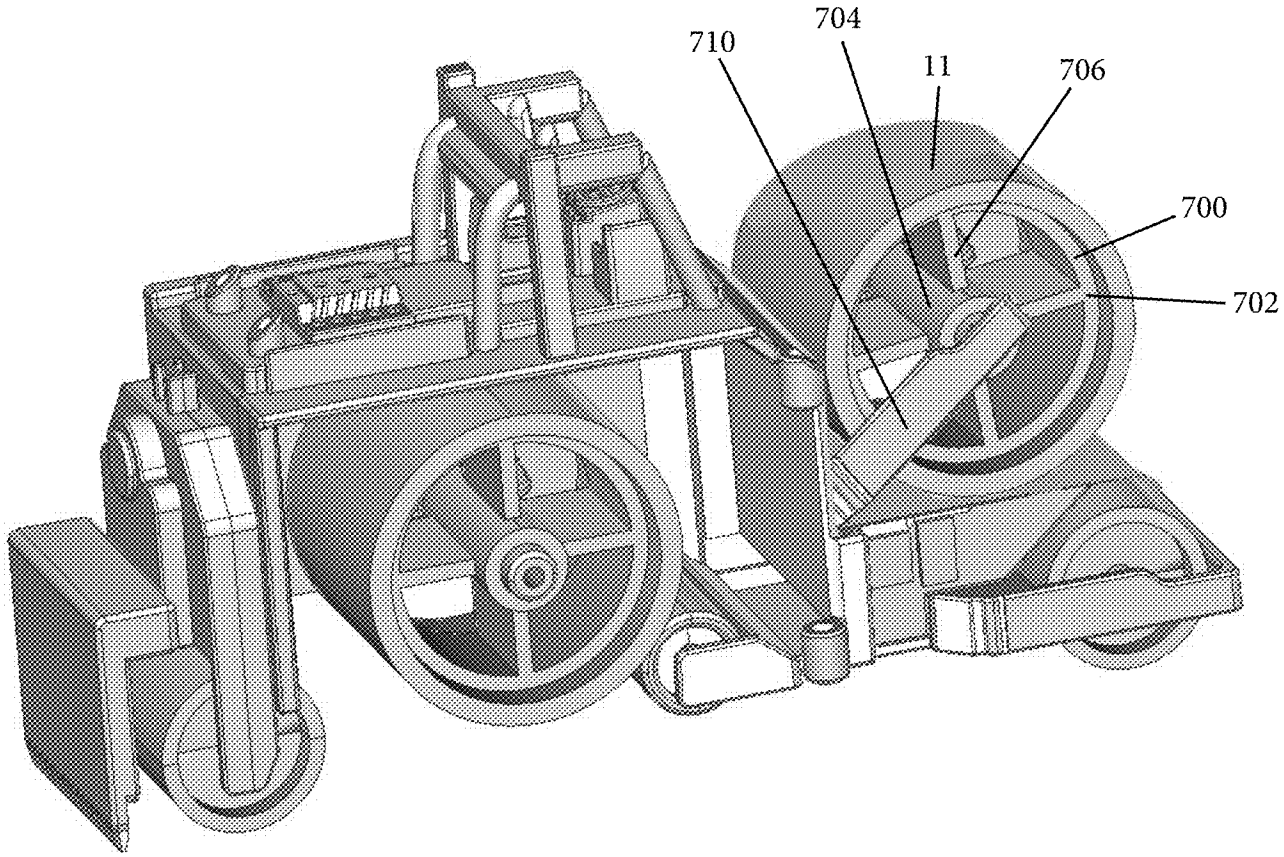

The forward portion 190 of the dispenser device 100 can optionally hold either: (1) a storage bin 600 to securely hold a second, spare tape roll 11 (FIG. 1); or, alternatively, as shown in FIG. 13, a second spindle 700 on which a second (secondary) roll 11 may be placed, and configured to be dispensed simultaneously with the primary tape roll 10. Both these configurations are discussed below.

In case 1, the forward portion 190 can have an upper body portion 250 that supports a bin (hopper) 600. The bin 600 has a hollow interior space 602 defined by a floor 603 surrounded by side walls 604 (which can be angled relative to the floor 603 at an angle other than 90 degrees).

The bin 600 is thus open along its top and accommodates and provides one or more important features of the present invention. Namely, the bin 600 has the ability to hold a spare tape roll (a secondary tape roll) 11. This is useful when the first tape roll 10 has been spent and the user is in immediate need of a second roll 11. The previous commercially available products failed to provide such a feature.

In case (1), the spare roll of tape 11 is preferably secured in place within the storage bin 600 in a detachable manner to allow the user to access and remove the secondary tape 11 when the tape roll 10 is exhausted. Any number of different techniques, including but not limited to a mechanical attachment or interference, can be used to detachably hold the secondary tape 11 in place. In the illustrated embodiment, opposing side walls 604 of the bin 600 have a pair of notches 605 and a pair of inwardly directed tabs (protrusions) 607 that are positioned at or near top edges of the notches 605. The secondary tape roll 11 is held in place by inserting it into the hollow interior space 602 of the bin 600 until the tape roll 11 contacts the tabs 607. Continued downward motion of the tape roll 11 causes a slight flexing of the tabs 607 (and/or the respective side walls 604) so that the tape roll 11 clears the tabs 607. As soon at the tape roll 11 clears the tabs 607, the tabs 607 spring back to their at rest positions and are disposed within the center hole of the tape roll 11, thereby capturing a lower portion of the tape roll 11 between the tabs 607 and the floor 603. To remove the tape roll 11, the side walls 604 can be flexed outwardly, thereby releasing the tabs 607 from engagement with the tape roll 11 and allow the tape roll 11 to be picked up and out of the bin 600.

These tabs 607 prevent the tape roll 11 from falling out of the dispenser device 100 when the device 100 is picked up or turned over. The spare tape roll 11 is immediately useful when the tape roll 10 has been expended and the user needs to continue "paving" his/her road.

Another feature of the present invention is the ability to dispense multiple tape rolls simultaneously, one on top of the other and this can be achieved in case two in which the bin 600 is removed and replaced with a second tape spindle as discussed below. This is ideal for creating special visual and physical effects on the road surface. Prior products did not contemplate this unique capability or value.

In particular, in case (2), as shown in FIG. 13, the bin 600 is replaced by the second spindle 700 along with side support arms 710 that are attached to the body (chassis) of the tape dispenser 100. The second spindle 700 can be the same or similar to the first spindle 200. Thus, the second spindle 700 can include an annular shaped outer wall 702 and a center hub 704 with a plurality of strengthening spokes (ribs) 706 extending, in a radial direction, between the center hub 704 and the outer wall 702.

The second spindle 700 is coupled to and rotates about a second spindle axle 701 that is coupled to the side support arms 710. The second spindle 700 is thus located above the front roller 220.

Figure 14:
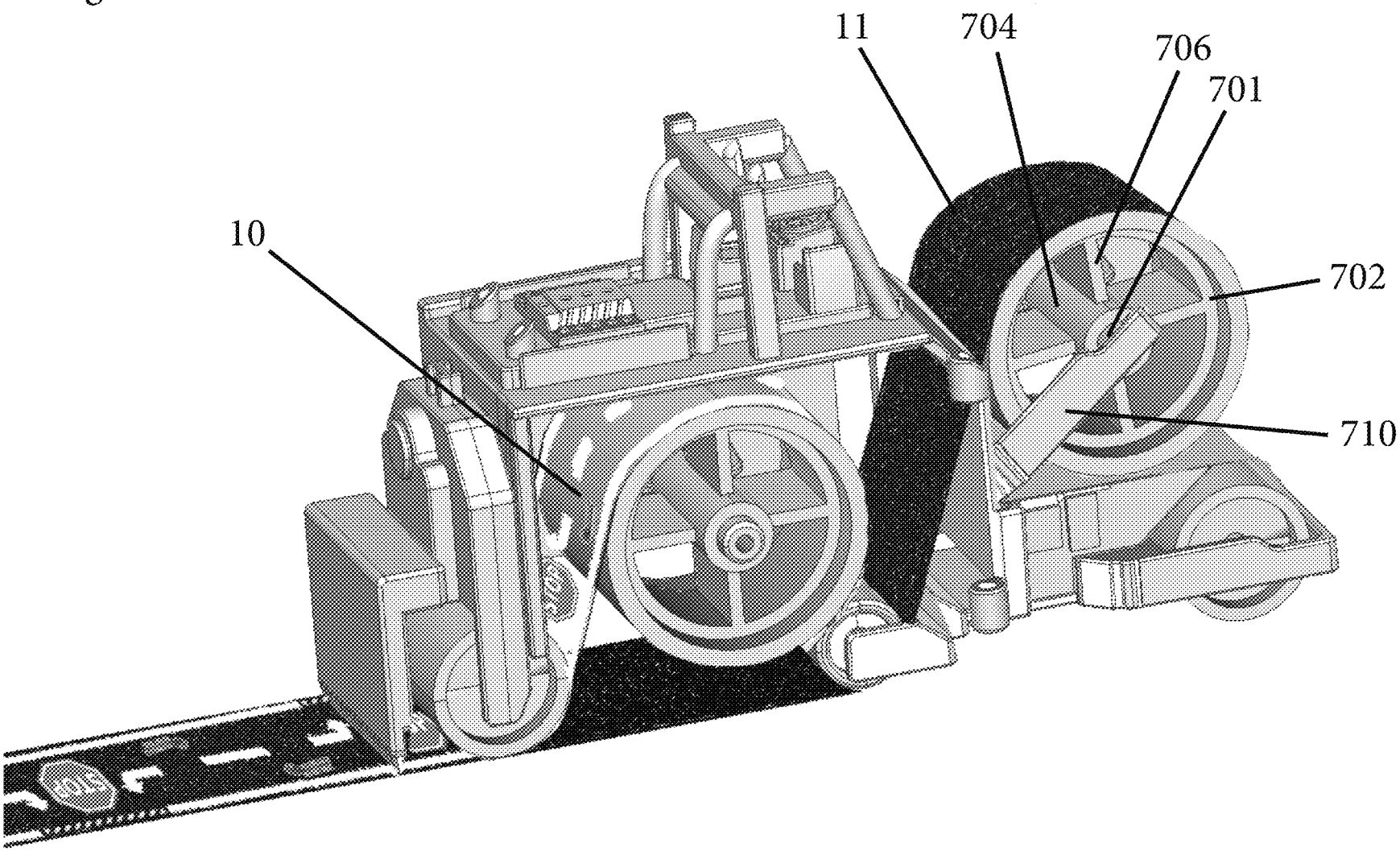

The front wall 130 can include a slot through which the second tape 11 passes from the location of the second spindle 700 to the main drive roller 210 where the secondary tape 11 passes underneath (FIG. 14). The drive roller 210 thus serves to lay down the secondary tape 11 as the dispenser device 100 moves forward. In this case, the forward portion of the drive roller 210 contacts the top side of the second tape 11 and the rear portion of the drive roller 210 contacts the upper surface of the first tape roll 10.

In other words, the second tape roll 11 is placed on the second spindle 700 and the second tape 11 is pulled under the front of the paver device 100 and under the drive roller 210 and out towards the back so that it may be dispensed simultaneously with the first tape roll 10 that is being metered off of the first spindle 200. Both tape layers 10, 11 are dispensed at the same time and the rear roller 400 pushes the two layers (two tapes 10, 11) together. The overlay roll, in this case the roll 10, is dispensed on top of the tape roll 11. It will be appreciated that unlike the first case in which the first roll 10 is the primary ground contacting tape, in the second case in which two tapes are applied, the first roll 10 functions as the overlay tape layer and it is the second tape 11 that is the ground-contacting tape.

Thus, in the case where there are two rolls of road tape 10, 11 being dispensed, the dispenser device 100 first dispenses the second tape roll 11 from the front of the dispenser device 100 and immediately thereafter dispenses the first tape roll 10, affixing and adhering the tape dispensed from the first tape roll 10 to the top surface of the tape dispensed from the second tape roll 11. In this arrangement, the ground contacting tape is the first tape to be applied (i.e., second tape roll 11), while the overlay tape roll (i.e., roll 10) becomes a second layer, atop the first tape layer.

It will be appreciated that more than two tape layers can be laid down over the applied surface as by having more than two spindles that meter off tape along dispensing paths that are layered with respect to one another and then ultimately, the rear roller 400 applies all layers to the applied surface.

The overlay tape roll (e.g., first tape roll 10 in FIG. 14) is an ideal way to create unique visual or physical effects on the applied tape road. For instance, the overlay tape roll may be made of a transparent tape that has printed opaque or partially transparent indicia of road markings, areas of damage on the road surface, debris on the road, roadkill, leaves, snow, ice, oil patch, or any other design. When applied on top of the road, the visual appearance of the road is that these visual effects are part of the road surface. Physical effects can be created by using a tape that has areas of physical relief, such as a raised fuzzy surface printed a green color to look and feel like grass or a bumpy surface to simulate bumps in the road. With a combination of different visual design and physical properties on the overlay tape roll, the laid road surface can take on an infinite number of different visual and physical forms.

As mentioned herein, the exterior of the tape dispenser 100 can be designed to be similar to a real-world road paving machine. The tape dispenser 100 preferably incorporates design features that copy real life paving machines. The front bin/hopper would hold raw asphalt. The front full width roller supports this hopper and the front part of the paver machine. The main body of the paver would process this asphalt internally and lay down a smooth flat surface at the rear. The rear full width roller helps in "flattening" the heated and processed asphalt. Further smoothening and compaction of the asphalt is accomplished with the rear most "screed" just behind the rear roller. The top of the tape dispenser 100 has an exposed engine along with exhaust pipes. There are two seats one for the driver and one for the asphalt controller. A full roll cage with warning lights covers the operator's area. Access to all of the internal processing is done by a large access door on the asphalt controller's side of the paver.

It will be appreciated that the present invention creates a method for enhancing the play pattern for a wide range of toys, from toy vehicles, to dolls, to figurines, to toy animals. This is accomplished through changes to the external design of the machine and the design of the tape in the tape dispenser 100. It can be appreciated that the toy tape used in the machine can be of any design such as those contemplated in U.S. Pat. No. 9,320,978. For instance, it may be designed as a train track for use with toy trains, or as a sidewalk for use with toy skateboards, or as a path for use with toy dolls, or as a strip of grass or field to be used with toy animals, or as a strip of distinctly colored or designed spaces for use as the basis of board game play with game pieces. The design of the exterior of the paving machine can likewise be restructured to reflect the theme of play. For instance, a toy ice-laying machine can be designed to look like a real-world Zamboni machine, or a toy grass-laying machine can be designed to look like a tractor. The variations are endless. In each variation, the mechanics of the paving machine are the same. The scale and visual design of the machine may change and the tape design may change. As such, the present invention adds a whole new level of play to a great many toys and play patterns, from toy vehicles, to dolls, to toy animals. Anything that can reasonably use a play surface that has a design on it can be enhanced by using the present paving machine to dispense that play surface.

In another embodiment of this invention, the tape that is dispensed has no adhesive. In this case, the tape can be of nearly any flexible, spooled material, including paper, plastic, fabric, or ribbon. The tape dispenser 100 is designed to be able to dispense any spooled material.

Figure 15:
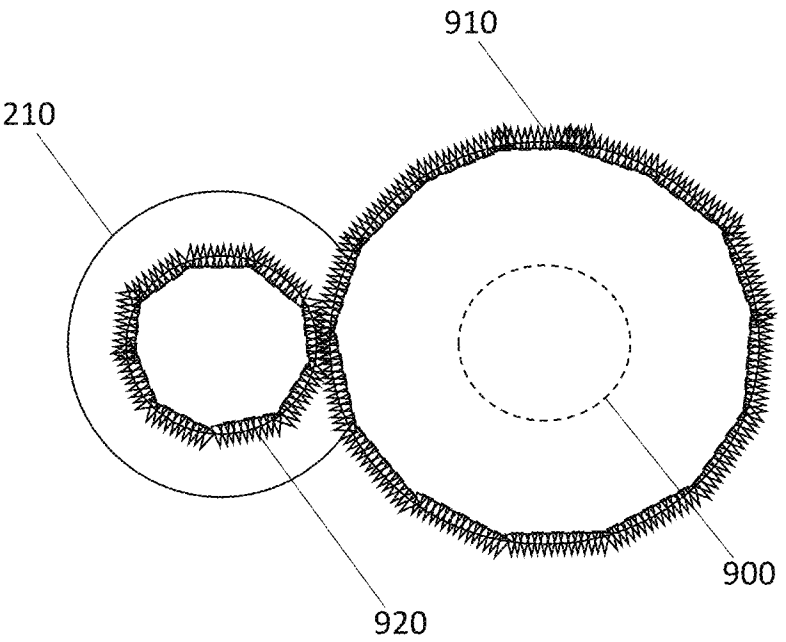
Figure 16:
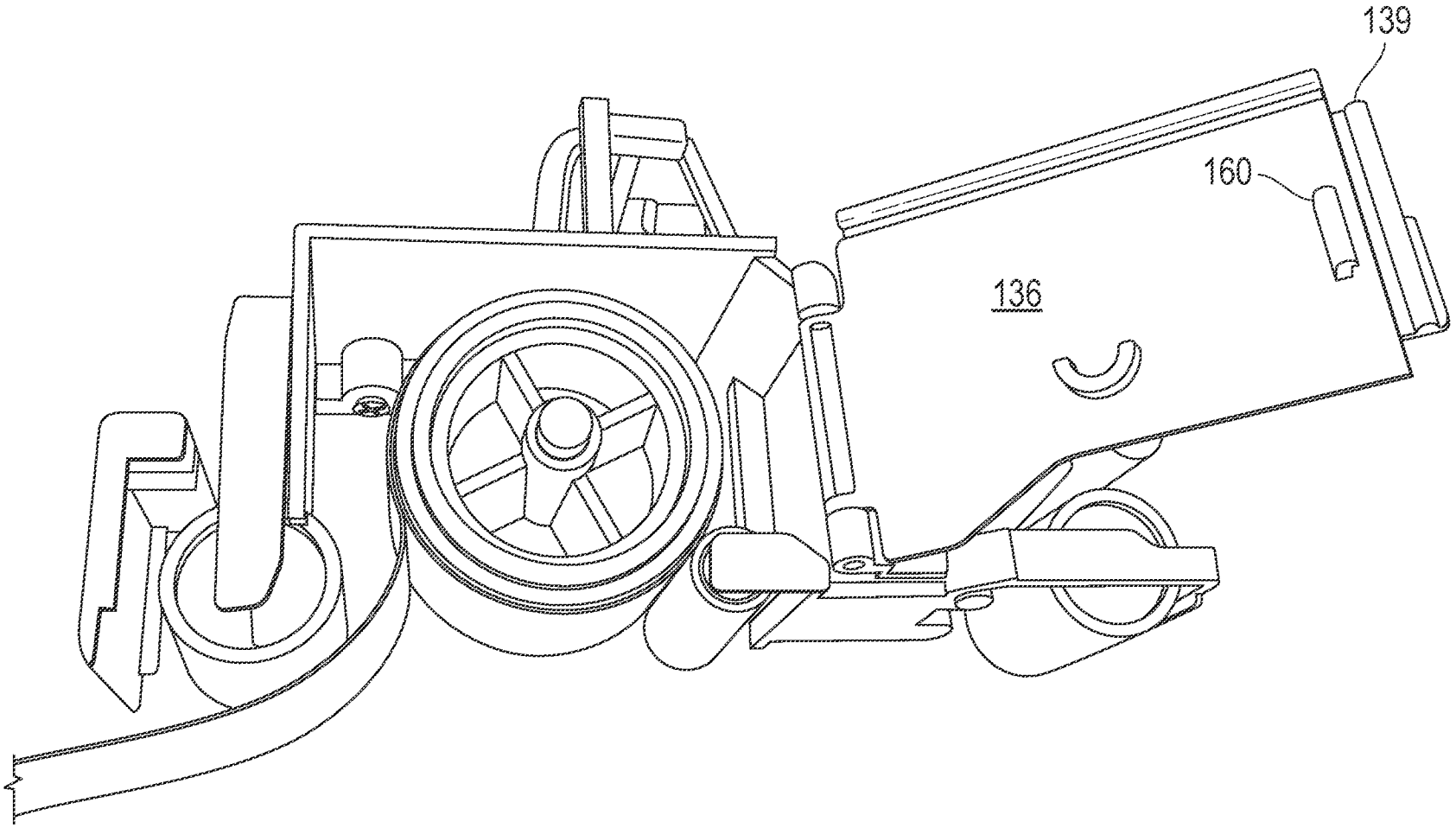

In another embodiment of this invention, as partially illustrated in FIG. 15, the tape dispenser 100 is mechanically powered to move forward and dispense tape on its own. For example, the dispenser device 100 can be motorized and more particularly, a motor 900 can be operatively coupled to the main roller 210 for controllably driving the tape dispenser 100. A power source, such as one or more batteries, (not shown) powers the motor 900.

The motor 900 can be optionally located on top of the paver (in place of the cockpit in the manual version of the tape dispenser 100) and be geared along the driver side of the paver body down to the drive roller 210. This location is the opposite side of the flip open door (second side wall 136) so it does not interfere with roll placing/removing. The motor 900 drives the surface-to-tape roller (drive roller 210), which at once moves the tape dispenser 100 forward and concurrently dispenses the tape 10 or tapes 10, 11 without the need for a human user to push the tape dispenser 100 forward.

The motor 900 can be located within the tape compartment 120 and can have a drive shaft that carries a first toothed gear 910 that intermeshes with a second toothed gear 920 that is carried by the axle of the drive roller 210. The drive shaft of motor 900 and the axle of the drive roller 210 can be parallel to one another. Thus, when the motor 900 is operated, the drive shaft rotates in a first direction causing rotation of the first gear 910 and this is translated into rotation of the second gear 920 which in turn causes rotation of the drive roller 210. Appropriate gear ratios can be utilized to cause the drive roller 210 to rotate at an appropriate speed to drive the tape dispenser 100 at a target speed to allow the metering out and application of the tape to the applied surface. The motor 900 and two gears 910, 920 can be located between the front wall 130 and the drive roller 210 (i.e., the forwardmost section of the hollow interior compartment (space) 120).

The dispenser device 100 can optionally include a second mechanism to mechanically press down the vertical plastic cutter to cut the tape at the desired length. The tape dispenser 100 may operate autonomously, moving forward and optionally cutting tape at either pre-defined intervals or more intelligently as may be controlled by a software algorithm combined with responses to sensor inputs. This motorized feature can also be mechanically or electronically timed so a preset length of tape is dispensed. The tape dispenser 100 can alternatively be operated via remote control, such as an RC remote control, or by other transmission means.

Thus, the present invention describes a tape dispenser for easily dispensing, laying down, cutting, and smoothing a single or multi-layered tape road or other graphic pathway for toy vehicle play. More generally, the tape dispenser can lay out any toy play surface printed on tape, a strip of paper, or other material. The tape dispenser can be operated manually or mechanically powered.

Although the present invention is described herein to be a particular size, accommodating a particular width and length tape road, the invention can be scaled proportionately to reasonably accommodate any width and length tape road.

The following list is a non-exhaustive list of advantageous features of the present invention:

1. Single-sided loading of tape roll on spindle and threading of tape path from roll to tape exit after vertical cutter.
2. Hinged flip opening side door for access of tape roll loading/unloading. No separate loose parts.
3. Surface-to-tape roller enables tape roll to unwind easily and evenly. Tape is not pulled or stretched as paver moves forward.
4. All rollers are coated or molded with a rubber finish to aid in tape roller rotation and gripping the ground surface.
5. Front bin feature holds and clips in spare roll.
6. Front bin feature can be removable and second spindle can be connected to front of paver allowing 2 tapes to be dispensed simultaneously. The first layer (Tape A) can be a base/substrate pattern such as pavement, grass, etc., and the second tape (Tape B, dispensed from inside paver unit) can achieve a second layer with snow banks, flowers, etc., on a clear substrate. This allows for customization by mixing the type of Tape A and Tape B patterns.
7. A vertical cutting feature is at the rear of the paver dispenser. The blade teeth are full width to the tape being dispensed. The blade teeth are vertical at 90 degrees to the tape surface. Cutting is by manually pushing down on this blade and pulling the paver up and forward. The resulting cut is therefore square to the direction of the tape and allows for more exacting positioning of a road intersection or a curve to the tape dispensed.
8. The machine can also be motorized and therefore move the paver dispenser forward and at the same time unroll the tape hands-free. This motorized feature can also be mechanically or electronically timed so a preset length of tape is dispensed or controlled remotely or operate autonomously.

Exemplary Use of the Dispenser Device

To use the toy road paving machine, the user follows these steps:

1. Open the flip door, exposing the spindle and threading area for the primary tape roll.
2. Before inserting the primary tape roll onto the exposed spindle, unroll by hand a small portion of the tape.
3. Insert the primary tape roll onto the spindle, concurrently threading the tape so the adhesive is facing down and the top surface of the tape is in contact with the rear most roller. Expose approximately 1½-2" of the tape, where approximately 1" is revealed behind the cutting blade.
4. Close the flip door.
5. Place the machine on a flat, hard surface such as a table or floor, tape side down.
6. Pull the machine evenly along the flat surface, with the front hopper in front. The machine will unroll the tape and lay it down onto the flat surface.
7. To cut the tape, press down on the vertical plastic cutter, engaging the teeth onto the exposed tape. While pressing down on the cutter, pull the machine up and away from the tape laid down. The tape will cut at the cut point.
8. Repeat steps 5-7 as desired.
9. When the tape roll runs out, repeat steps 1-4. Use the optional spare roll in the storage bin.

What is claimed is:

1. A toy for laying down a toy play surface on a target surface comprising:

a vehicle body with rotatable wheels, the vehicle body having an interior compartment that contains a first rotatable spindle on which a first tape roll can be mounted, the first tape roll defining the toy play surface;

a first drive roller that comprises one of the vehicle wheels in contact with the target surface and positioned forward of the first rotatable spindle and further configured to be in contact with the first tape roll on the first spindle such that rotation of the first drive roller causes unwinding of the first tape roll;

wherein the first drive roller includes a mechanism for applying an urging force to the first drive roller causing the first drive roller to be biased in a direction toward the first rotatable spindle to ensure that the first drive roller remains in constant contact with the first tape roll while the first tape roll remains on the first spindle, wherein a bottom region of the first drive roller remaining in direct contact with the target surface and being free of contact with the first tape roll during movement of the vehicle body over the target surface.

2. The toy of claim 1, wherein the toy play surface comprises a tape having a top surface and an adhesive on a bottom face thereof.

3. The toy of claim 1, wherein the interior compartment includes a front wall, a rear wall, a first side wall and an openable and closeable door disposed opposite the first side wall so as to define an enclosed interior space in which the first rotatable spindle is disposed.

4. The toy of claim 3, wherein the door is hingedly attached to one of the front wall and the rear wall and includes a closing mechanism to ensure the door remains closed during use.

5. The toy of claim 4, wherein the closing mechanism comprises a male feature formed on one of the door and the front or rear wall and a female feature formed on the other of the door and the front or rear wall.

6. The toy of claim 1, wherein the vehicle wheels are further defined by a front roller located forward of the drive roller and a rear roller located rearward of the drive roller, the rear roller configured to apply a force to the first tape roll that travels along a first tape dispensing path from the first rotatable spindle and passes underneath the rear roller.

7. The toy of claim 6, wherein the rear roller is partially contained within the interior compartment and the first rotatable spindle is disposed between the first drive roller and the rear roller.

8. The toy of claim 1, wherein the first drive roller is entirely disposed within the interior compartment.

9. The toy of claim 1, wherein the mechanism includes a tension bar or a biasing member.

10. The toy of claim 1, further including a cutter that is disposed at a rear or front of the vehicle body.

11. The toy of claim 10, wherein the cutter comprises one of: (1) a cutter body terminating in a plurality of teeth formed so as to span an entire width of the first tape roll and are positioned at 90 degrees relative to the target surface on which the toy play surface is laid; and (2) a cutter body with a straight cutting edge.

12. The toy of claim 11, wherein the cutter is disposed rearward of a rearmost vehicle wheel.

13. The toy of claim 1, further including a bin coupled to the vehicle body, the bin defining a secondary tape compartment in which a second tape roll can be disposed.

14. The toy of claim 13, wherein the bin includes a securing mechanism for releasably holding the second tape roll in place.

15. The toy of claim 14, wherein the securing mechanism comprises a pair of tabs formed on opposing side walls of the bin and protruding inwardly therefrom, the tabs being spaced upwardly from a floor of the bin so as to permit capture of the second tape roll between the tabs and the floor of the bin.

16. The toy of claim 15, wherein the opposing side walls are formed at an angle other than 90 degrees relative to the floor.

17. The toy of claim 1, wherein the first drive roller is operatively coupled to a motor for controlled automated rotation of the first drive roller and the motor is optionally connected to a remote controller for controlling movement and operation of the toy.

18. The toy of claim 17, wherein the motor has a drive shaft containing a first gear and the first drive roller has a second gear that is intermeshed with the first gear such that rotation of the drive shaft causes rotation of the first drive roller.

19. The toy of claim 18, wherein the motor, the first gear and the second gear are entirely disposed within the interior compartment.

20. A toy for laying down a toy play surface on a target surface comprising:

a vehicle body with rotatable wheels, the vehicle body having an interior compartment that contains a first rotatable spindle on which a first tape roll can be mounted, the first tape roll defining the toy play surface;

a first drive roller that comprises one of the vehicle wheels and is positioned forward of the first rotatable spindle and an upper region of the first drive roller being in direct contact with the first tape roll while the first tape roll remains on the first spindle such that rotation of the first drive roller causes unwinding of the first tape roll, wherein the first drive roller is biased toward the first rotatable spindle to ensure that the first drive roller remains in constant contact with the first tape roll while the first tape roll remains on the first spindle;

a second rotatable spindle on which a second tape roll can be mounted, the second rotatable spindle being disposed forward of the first driver roller and defining a second tape dispensing path whereby the second tape roll unwinds from the second rotatable spindle and is fed beneath and in direct contact with a lower region of the first drive roller which applies force to the second tape roll for applying the second tape roll to the target surface, whereby the toy play surface comprises a layered structure in which tape of the second tape roll comprises a bottom layer that is applied to the target surface prior to application of tape of the first tape roll to the target surface and tape of the first tape roll comprises an overlay layer that is disposed on top of the bottom layer.

21. The toy of claim 20, wherein the upper region comprises a top half of the first drive roller, while the bottom region comprises a lower half of the first drive roller.

22. The toy of claim 20, wherein the overlay layer includes physical effects that are laid over the bottom layer.

23. The toy of claim 22, wherein the overlay layer comprises a transparent tape and the physical effects comprise printed opaque or partially transparent indicia.

24. The toy of claim 22, wherein the physical effects can be indicia that is raised relative to surrounding portions of the overlay layer.

25. A method for laying down a toy play surface on a target surface comprising the step of:

providing a toy vehicle that includes a vehicle body with rotatable wheels, the vehicle body having an interior compartment that contains a first rotatable spindle on which a first tape roll is mounted, the first tape roll defining the toy place surface, the toy vehicle further including a first drive roller that comprises one of the vehicle wheels that is always in direct contact with the target surface as the toy vehicle travels along the target surface and is positioned forward of the first rotatable spindle, wherein the first drive roller includes a mechanism for applying an urging force to the first drive roller causing the first drive roller to be biased in a direction toward the first rotatable spindle to ensure that the first drive roller remains in constant contact with the first tape roll while the first tape roll remains on the first spindle; and moving the toy vehicle in a forward direction along the target surface to cause the drive roller to travel along the target surface while the drive roller remains in contact with first tape roll on the first spindle resulting in rotation of the first spindle and unwinding of the first tape roll onto the target surface.

* * * * *